US006178304B1

(12) United States Patent
Sakai

(10) Patent No.: US 6,178,304 B1
(45) Date of Patent: Jan. 23, 2001

(54) IMAGE FORMING APPARATUS AND INK SOLIDIFYING METHOD IN IMAGE FORMING APPARATUS

(75) Inventor: Shinichi Sakai, Niigata (JP)

(73) Assignee: NEC Corporation, Tokyo (JP)

( * ) Notice: Under 35 U.S.C. 154(b), the term of this patent shall be extended for 0 days.

(21) Appl. No.: 09/452,086

(22) Filed: Nov. 30, 1999

(30) Foreign Application Priority Data

Jan. 12, 1998 (JP) ..... 10-341551

(51) Int. Cl.[7] ..... G03G 15/10
(52) U.S. Cl. ..... 399/251
(58) Field of Search ..... 399/251, 92, 307

(56) References Cited

U.S. PATENT DOCUMENTS 3,957,369 * 5/1976 Wirth .
4,538,899 * 9/1985 Landa et al. .
5,053,823 * 10/1991 Ohishi et al. .
5,420,673 * 5/1995 Itoh .

FOREIGN PATENT DOCUMENTS 58-90645 5/1983 (JP) .
59-129888 7/1984 (JP) .
59-168470 9/1984 (JP) .
63-113576 5/1988 (JP) .
1-253756 10/1989 (JP) .
3-168771 7/1991 (JP) .
4-350877 * 12/1992 (JP) .
8-190276 * 7/1996 (JP) .
11-038768 * 2/1999 (JP) .

* cited by examiner

*Primary Examiner*—Robert Beatty
(74) *Attorney, Agent, or Firm*—Ostrolenk, Faber, Gerb & Soffen, LLP

(57) ABSTRACT

An image forming apparatus and an ink solidifying method in the image forming apparatus can efficiently perform solidification of an ink on a photosensitive belt developed and transferred to an image transfer process with simple construction. The image forming apparatus has a photosensitive belt, on which a latent image is formed, a developing roller for developing the latent image on the photosensitive belt with an ink prepared by dispersing toner particle in a predetermined solvent, a transfer roller placed in contact with the photosensitive belt and having a heater therewithin, the transfer roller transferring an ink of a developed image on the photosensitive belt on to a paper, a fuser roller placed in contact with the transfer roller and having a heater therewithin, the fuser roller being cooperated with the transfer roller for feeding the paper therebetween, and hot air blowing means located between a developing position where the developing roller is provided and a transfer portion where the transfer roller is provided, for blowing a hot air onto the ink forming the developed image.

14 Claims, 2 Drawing Sheets

IMAGE FORMING APPARATUS AND INK SOLIDIFYING METHOD IN IMAGE FORMING APPARATUS

BACKGROUND OF THE INVENTION

1. Field of the Invention

The present invention relates generally to an image forming apparatus and an ink solidifying method for use with an image forming apparatus. More particularly, the invention relates to an image forming apparatus and an ink solidifying method in which a latent image is created on a photosensitive medium, the latent image is developed by application to the photosensitive medium, of an ink comprised of a toner dispersed in a liquid solvent, the solvent is removed to solidify the ink, and the developed image is then transferred to The image recording medium such as paper and fixed to provide a permanent image.

2. Description of Related Art

Conventionally, in one known type of apparatus, a latent image is created by scanning a photoconductive medium such as a belt or drum with a laser beam or the like modulated in accordance with image data. The latent image is developed using a liquid ink of the type described above. The ink is then dried by removing the solvent, and the developed image is transferred to The image receiving medium such as paper. This is often done with an intermediate transfer medium such as a transfer roller using heat and pressure. The transfer medium may be formed of a material selected to have a greater affinity for the dried toner particles than the photoconductive medium, but a lower affinity for the toner particles than the image receiving medium.

One way the solvent is often removed is first to squeeze as much as possible off the surface of the photoconductive medium with a roller, and then to remove the residue using a drying unit constructed with an absorbing roller for absorbing the solvent and a drying roller for evaporating the solvent absorbed by the absorbing roller by heat.

However, the drying unit used in the conventional image forming apparatus is constructed of a large number of parts and is quite costly.

Furthermore, since the absorbing roller is directly contacted with the drying roller, the ink may deposit on the drying roller to degrade performance of the absorbing roller and the drying roller.

In order to solve the foregoing problems, measures, such as providing a cleaning mechanism for the roller, have been considered. However, such measure increase the number of parts and the cost.

SUMMARY OF THE INVENTION

The present invention is worked out in view of the problems set forth above. Therefore, it is an object of the present invention to provide an image forming apparatus and an ink solidifying method in the image forming apparatus which can efficiently perform solidification of an ink on a photosensitive belt developed and transferred to an image transfer process with simple construction.

According to one aspect of the present invention, an image forming apparatus comprises:

a photosensitive belt, on which a latent image is formed;

a developing roller for developing the latent image on the photosensitive belt with an ink prepared by dispersing toner particle in a predetermined solvent;

a transfer roller placed in contact with the photosensitive belt and having a heater therewithin, the transfer roller transferring an ink of a developed image on the photosensitive belt on to a paper;

a fuser roller placed in contact with the transfer roller and having a heater therewithin, the fuser roller being cooperated with the transfer roller for feeding the paper therebetween; and hot air blowing means located between a developing position where the developing roller is provided and a transfer portion where the transfer roller is provided, for blowing a hot air onto the ink forming the developed image.

By blowing hot air by the hot air blowing means, the solvent in the ink is evaporated for solidification of the ink. Accordingly, by simply means, such as that blowing hot air, ink can be dried. Also, since the ink can be dried without contacting to the photosensitive belt, problem of causing stain due to deposition of the ink and disturbance of the image can be avoided to achieve steady image.

In order to avoid adverse influence for the photosensitive belt by the pressure and head of the hot air of the hot air blowing means, the hot air blowing means may blow hot air onto the photosensitive belt guided by a guide roller at a location between the developing position where the developing roller is provided and the transfer portion where the transfer roller is provided.

By providing a heat source located in the vicinity of the photosensitive belt running from the developing position where the developing roller is provided to the transfer portion where the transfer roller is provided, hot air can be blown onto the photosensitive belt efficiently. On the other hand, by providing a blower for blowing the hot air generated by the heat source toward the photosensitive belt, hot air can be certainly blown onto the photosensitive belt.

By using waste heat of the transfer roller and/or the fuser roller as a heat source of the hot air blowing means, power consumption of the overall apparatus can be reduced. Also, by providing the blower for blowing the hot air generated by the heat source toward the photosensitive belt, waste heat can be efficiently blown onto the photosensitive belt.

It is also possible to provide a blower duct between the transfer roller or the fuser roller and a position opposing to the photosensitive belt between the developing roller and the transfer roller, and the blower is provided within the blower duct for certainly draw waste heat of the transfer roller and/or the fuser roller to toward the photosensitive belt.

Furthermore, by using a hot air generated by a control portion controlling operation of the image forming apparatus as a heat source of the hot air blowing means, heat to be generated in the apparatus can be used further effectively.

According to another aspect of the present invention, an image forming apparatus comprises:

a photosensitive belt serving as a photo conductor forming a latent image thereon;

a developing roller for developing the latent image on the photosensitive belt with an ink prepared by dispersing toner particle in a predetermined solvent;

a transfer roller placed in contact with the photosensitive belt and having a heater therewithin, the transfer roller transferring an ink of a developed image on the photosensitive belt on to a paper;

a fuser roller placed in contact with the transfer roller and having a heater therewithin, the fuser roller being cooperated with the transfer roller for feeding the paper therebetween; and hot air blowing means located between a developing position where the developing roller is provided and a transfer portion where the transfer roller is provided, for blowing a hot air onto the ink forming the developed image.

BRIEF DESCRIPTION OF THE DRAWINGS

The present invention will be understood more fully from the detailed description given hereinbelow and from the accompanying drawings of the preferred embodiment of the present invention, which, however, should not be taken to be limitative to the invention, but are for explanation and understanding only.

In the drawings.

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessarily obscure the present invention.

Figure 1:
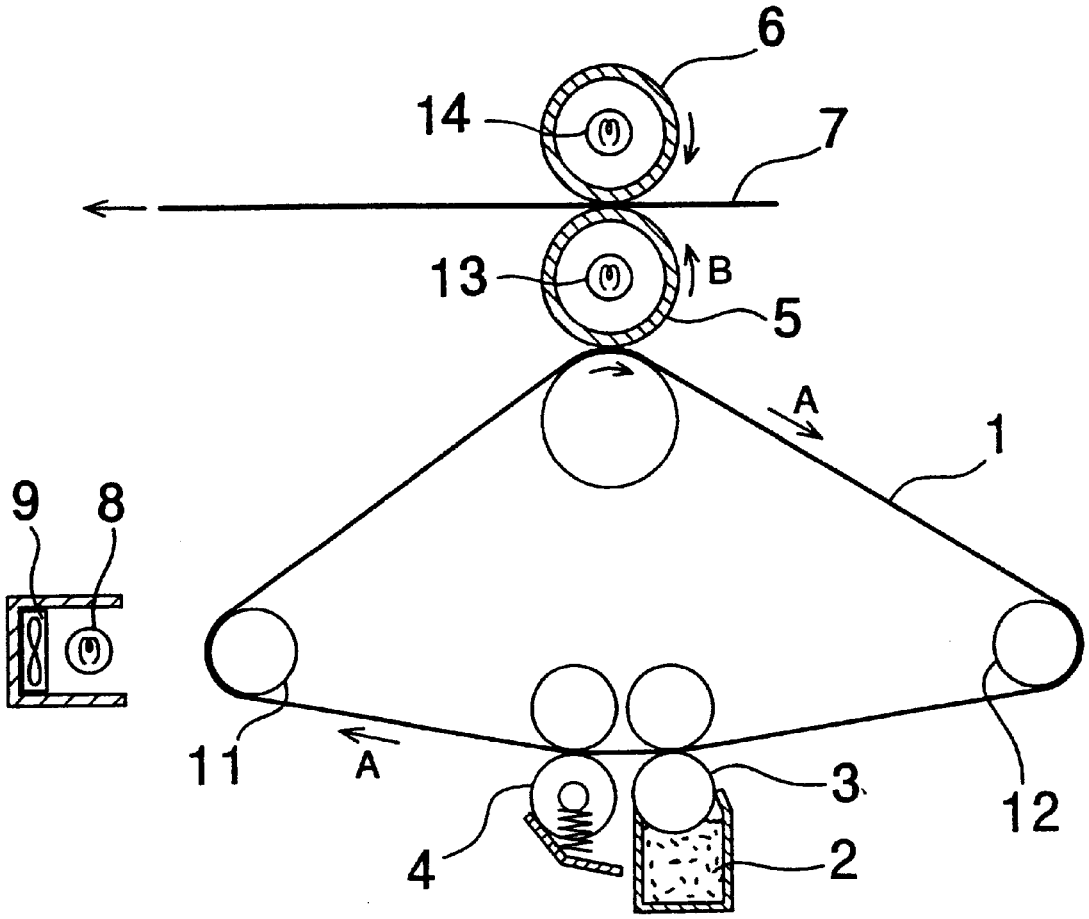
FIG. 1 is a schematic illustration showing a general construction of one embodiment of an image forming apparatus according to the present invention.

Referring to FIG. 1, one embodiment of an image forming apparatus according to the present invention includes a photosensitive belt 1 as a photo conductor for forming a latent image, a developing roller 3 for developing the latent image on the photosensitive belt 1 with an ink which is prepared by dispersing a toner particle in a solvent, a squeezing roller 4 placed in contact with the photosensitive belt for applying a pressure onto the ink forming a developed image for squeezing off the solvent, a transfer roller 5 placed in contact with the photosensitive belt 1 and having a heater 13 therewithin, and a fuser roller 6 placed in contact with the transfer roller 5 and having a heater 4 therewithin. The transfer roller 5 and the fuser roller 6 define a nip portion therebetween, through which a paper 7 is transferred by means of a transporting roller (not shown).

The photosensitive belt 1 is transferred from a developing position for developing an image by the developing roller 3 to an image transfer position for transferring the developed image by the transfer roller as guided by a guide roller 11 across a squeezing position by the squeezing roller 4. Then, the photosensitive belt 1 is circulated back to the developing position to mate with the developing roller as guided by a guides roller 12.

The ink forming the developed image on the photosensitive belt 1 is solidified by removal of the solvent by heat, pressure and so forth. The solidified ink has a property to be transferred to a substance having a greater affinity. Affinities with the ink of the photosensitive belt 1, the transfer roller 5 and the paper 7 are set to be greater in this order. Thus, the ink image on the photosensitive belt 1 is transferred onto the transfer roller 5 having greater affinity, and then transferred from the transfer roller 5 to the paper 7 which has affinity greater than that of the transfer roller 5.

On the other hand, in the vicinity of a position to mate with the guide roller 11, namely in the vicinity of a position where the photosensitive belt 1 running from the developing position by the developing roller 3 to the transfer position by the transfer roller 5, is guided by the guide roller 11, a heat source 8, such as heater or the like, and a blower 9 for blowing a hot air generated by the heat source 8 toward the photosensitive belt 1, as hot air blowing means for removing the solvent of the ink 2, are provided.

Next, an ink solidifying method in the image forming apparatus will be discussed together with operation of the shown embodiment of the image forming apparatus according to the present invention.

The photosensitive belt 1 is circulated in the direction of arrow A in FIG. 1. While circulated, a photosensitive surface of the photosensitive belt 1 is uniformly charged by a not shown charging device. Thereafter, by irradiation of an irradiation light, such as a not shown laser or so forth, a predetermined latent image is formed on the photosensitive surface.

Next, similarly to the case of the known electrophotographic system, the ink 2 which is prepared by dispersing the toner particle in the solvent, is deposited on the portion of the photosensitive belt where the latent image is formed. Thus, the latent image is developed.

The ink 2 forming the developed image on the photosensitive belt 1 is solidified by removing the solvent by heat, pressure or so forth, as set forth above. Then, the solidified ink 2 is provided the property to be transferred to the substance having greater affinity.

Accordingly, by applying the pressure onto the developed image of the ink 2 on the photosensitive belt 1 by means of the squeezing roller 4, the solvent in the ink 2 is removed in certain extent to cause solidification of the ink 2 forming the developed image in certain extent. Furthermore, the hot air generated by the heat source 8 is blown onto the ink 2 by means of the blower 9 to cause evaporation of the solvent to cause sufficient solidification.

Then, by providing greater affinity with the ink 2 for the transfer roller 5 than that of the photosensitive belt 1, the ink 2 on the photosensitive belt 1 is transferred to the transfer roller 5. On the other hand, the transfer roller 5 is rotated in the direction of arrow B to be heated by the heater built-in the transfer roller 5. Then, the paper 7 is transported into the nip portion defined between the transfer roller 5 and opposing fuser roller 6.

At this time, the affinity of the transfer roller 5 with the ink 2 is set to be smaller than that of the paper 7. Thus, the solidified ink 2 is transferred from the transfer roller 5 to the paper 7.

On the other hand, by heat and pressure applied to the ink by the heaters in the transfer roller 5 and the fuser roller 6, the solvent in the ink can be removed completely. Therefore, toner is fixed on the paper 7.

Here, as shown in FIG. 1, in the shown embodiment of the image forming apparatus according to the present invention, known heat source 8 is provided for blowing the hot air of a predetermined temperature onto the photosensitive belt at a predetermined flow rate to appropriately solidify the ink on the photosensitive belt.

Thus, in the shown embodiment, at a position opposing to the photosensitive belt at a location between the transfer roller 5 and the squeezing roller 4, a mechanism for blowing the hot air is provided to certainly perform solidification of the ink 2 to realize the image forming apparatus which can obtain steady image at low cost.

On the other hand, since drying of the ink 2 in non-contact condition, defect of the image due to deposition of the ink or degradation of drying performance due to stain of the roller may not be caused. Therefore, stable performance can be maintained.

Figure 2:
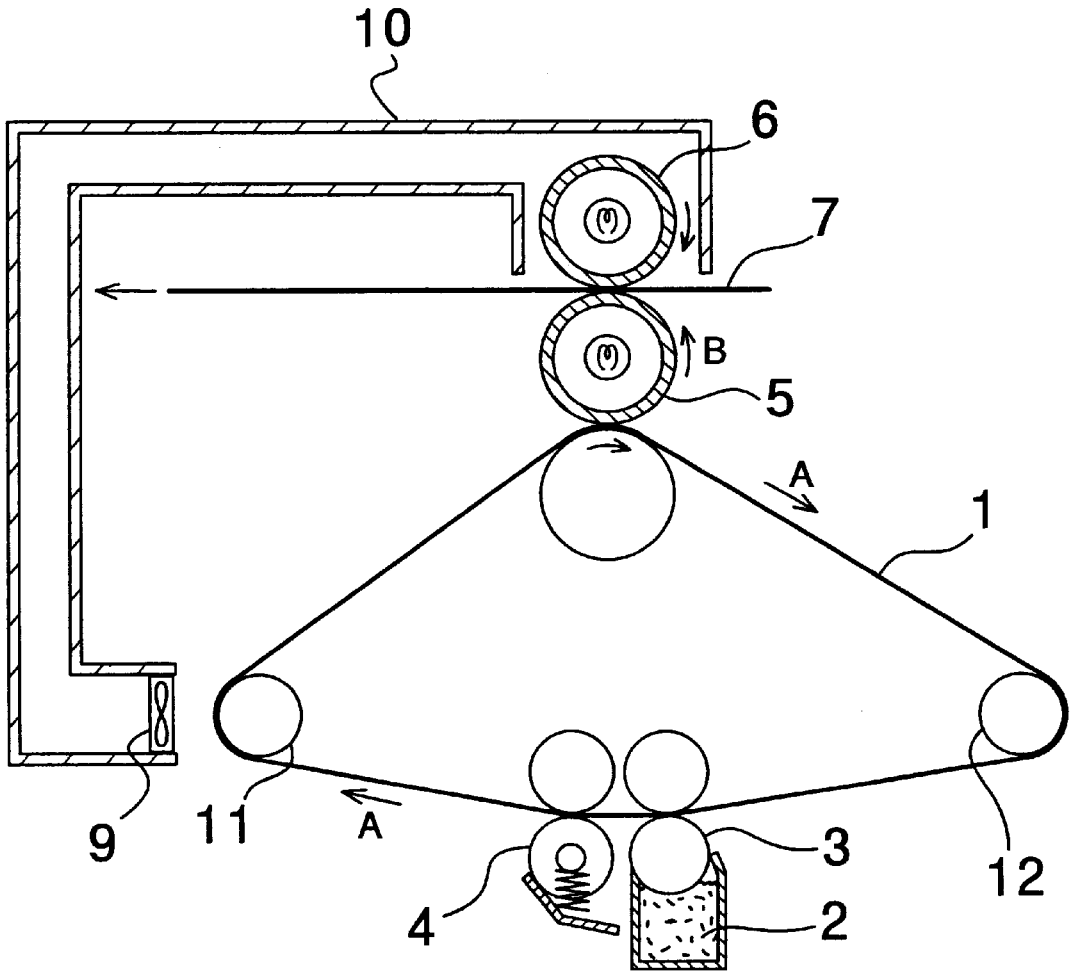
FIG. 2 is a schematic illustration showing a general construction of another embodiment of an image forming apparatus according to the present invention.

On the other hand, FIG. 2 shows another embodiment of the image forming apparatus according to the present invention. A duct 10 is employed and the fuser roller 6 is located within one end portion of the duct 10. The other end of the duct 10 is located in the vicinity of the guide roller 11 with placing the blower 9 within the other end portion of the duct 10. Then, waste heat of the fuser roller 6 and the transfer roller 5 is sucked into the duct to be blown onto the photosensitive belt 1 at a predetermined flow rate by the blower 9 at the position where the photosensitive belt 1 transported from the developing position where the image is developed by the ink 2, to the transfer position with the transfer roller 5, is guided by the guide roller 11. It should be noted that waste heat of a not shown control unit, a power source or so forth may also be utilized in the similar manner.

With taking the construction set forth above, power consumption of the apparatus can be reduced by utilizing the existing heat generating body as heat source.

As set forth above, according to the present invention, by blowing hot air onto the ink on the photosensitive belt by the hot air blowing means, the solvent in the ink is evaporated for solidification of the ink. By this, by simply means to blow the hot air, the ink can be dried. In conjunction therewith, since the ink on the photosensitive belt can be dried in non-contact manner, solidification of the ink can be performed efficiently to avoid shortcoming, such as stain due to deposition of the ink or disturbance of the image, to cause difficulty in obtaining steady image.

By blowing the hot air at the position there the photosensitive belt is guided by the guide roller, adverse influence of the pressure and heat of the hot air from the hot air blowing means can be avoided.

Also, by providing the hot air in the vicinity of the photosensitive belt, the hot air can be efficiently blown onto the photosensitive belt. Furthermore, by providing the heat source and the blower, the hot air can be certainly blown onto the photosensitive belt. Thus, drying of the ink and stabilizing of the image can be achieved certainly.

On the other hand, by utilizing the waste heat of the transfer roller and/or the fuser roller as the heat source, overall power consumption of the apparatus can be reduced. Namely, by providing the blower to blow the waste heat of the transfer roller and the fuser roller onto the photosensitive belt, the waste heat can be blown onto the photosensitive belt efficiently. Thus, drying of the ink and stabilizing of the image can be achieved certainly.

Then, by providing a blower duct between the position opposing to the transfer roller, the fuser roller and the photosensitive belt, and the blower is provided within the blower duct, the waste heat of the transfer roller and the fuser roller can be certainly drawn to the photosensitive belt.

Furthermore, by using hot air generated in the control portion controlling operation of the apparatus, as heat source, the heat generated in the apparatus can be used further efficiently.

Although the present invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the feature set out in the appended claims.

What is claimed is:

1. An image forming apparatus comprised of:

a photosensitive belt;

an imaging device which forms a latent image on the first side of the photosensitive belt;

a developing unit including a developing roller positioned in contact with the photosensitive belt, and an ink supply unit which provides ink in the form of toner particles dispersed in a solvent to the developing roller;

a transfer roller having a heater therein, the transfer roller being positioned in contact with the photosensitive belt;

a fusing roller having a heater therein, the fusing roller being positioned in contact with the transfer roller, the transfer roller and the fusing roller cooperating to feed the image receiving medium between the rollers, to transfer ink from the developed image on the belt to the image receiving medium and to fuse the transferred ink on the image receiving medium;

a guide roller located between the developing roller and the transfer roller, and positioned in contact with the photosensitive belt; and a hot air blowing unit which blows hot air onto the developed image on a section of the belt which is adjacent to the guide roller.

2. The image forming apparatus described in claim 1, wherein the hot air blowing unit is comprised of a heat source and an air blower positioned adjacent to the heat source which directs heat from the heat source toward a surface of the belt.

3. The image forming apparatus described in claim 2, wherein the air blower directs heated air onto the belt in an area where the belt is in contact with the guide roller.

4. The image forming apparatus described in claim 1, wherein the hot air blowing unit includes:

a duct having a first end positioned to receive heated air from the vicinity of the transfer roller and the fusing roller; and an air blower positioned at a second end of the duct which draws heated air from the duct and directs it toward a surface of the belt.

5. The image forming apparatus described in claim 4, wherein the air blower directs heated air onto the belt in an area where the belt is in contact with the guide roller.

6. The image forming apparatus as defined in claim 4, wherein the heated air received from the duct is waste heat generated during the creation of the image on the image receiving medium.

7. The image forming apparatus as defined in claim 4, wherein the heated air received from the duct is waste heat generated by the heaters in the transfer roller and the fusing roller.

8. The image forming apparatus as defined in claim 4, wherein the heated air is generated as a by-product of operation of the apparatus itself.

9. The image forming apparatus described in claim 1, wherein the hot air blowing unit directs heated air onto the belt in an area where the belt is in contact with the guide roller.

10. The image forming apparatus described in claim 1, wherein the transfer roller is formed of a material which has a greater affinity for the dried toner particles than the photoconductive medium, but a lower affinity for the toner particles than the image receiving medium.

11. An image forming apparatus comprised of:

a photosensitive belt;

an imaging device which forms a latent image on the photosensitive belt;

a developing unit including a developing roller positioned in contact with the photosensitive belt, and an ink supply unit which provides ink in the form of toner particles dispersed in a solvent to the developing roller;

a transfer roller having a heater therein, the transfer roller being positioned in contact with the photosensitive belt;

a fusing roller having a heater therein, the fusing roller being positioned in contact with the transfer roller, the transfer roller and the fusing roller cooperating to feed the image receiving medium between the rollers, to transfer ink from the developed image on the belt to the image receiving medium and to fix the transferred ink on the image receiving medium; and a hot air blowing unit positioned between the developing roller and the transfer roller which blows air heated by waste heat generated during the creation of the image on the image receiving medium onto the developed image on the belt.

12. The image forming apparatus described in claim 11, wherein the hot air blowing unit includes an air blower positioned adjacent to the belt which directs the waste heat toward a surface of the belt.

13. The image forming apparatus described in claim 11, wherein the hot air blowing unit includes:

a duct having a first end positioned to receive heated air from the vicinity of the transfer roller and the fusing roller; and an air blower positioned at a second end of the duct which draws heated air from the duct and directs it toward a surface of the belt.

14. The image forming apparatus described in claim 11, wherein the transfer roller is formed of a material which has a greater affinity for the dried toner particles than the photoconductive medium, but a lower affinity for the toner particles than the image receiving medium.

* * * * *

UNITED STATES PATENT AND TRADEMARK OFFICE

CERTIFICATE OF CORRECTION

PATENT NO. : 6,178,304 B1
DATED : January 23, 2001
INVENTOR(S) : Shinichi Sakai

It is certified that error appears in the above-identified patent and that said Letters Patent is hereby corrected as shown below:

Item [30] Foreign Priority Data should read:

-- Dec. 1, 1998 (JP) 10-341551 --

Signed and Sealed this

Twenty-eighth Day of August, 2001

*Attest:*

Nicholas P. Godici

NICHOLAS P. GODICI

*Attesting Officer*

*Acting Director of the United States Patent and Trademark Office*